United States Patent [19]

Sheldon

[11] Patent Number: 4,848,958

[45] Date of Patent: Jul. 18, 1989

[54] RECESSED DEFLECTING ROAD REFLECTOR

[76] Inventor: Steven A. Sheldon, 8388 Santa Berta Way, Buena Park, Calif. 90620

[21] Appl. No.: 254,103

[22] Filed: Oct. 6, 1988

[51] Int. Cl.[4] ..... E01F 9/00

[52] U.S. Cl. ..... 404/11

[58] Field of Search ..... 404/9, 10, 11; 116/63 R

[56] References Cited

U.S. PATENT DOCUMENTS

| | | | |
|---|---|---|---|
| 1,845,774 | 2/1932 | Wilson | 404/11 |
| 2,176,285 | 6/1937 | Whiting | 404/11 |
| 2,519,145 | 8/1950 | Manly | 404/11 |
| 4,130,370 | 12/1978 | Kone | 404/11 |
| 4,140,418 | 2/1979 | Holley | 404/11 |
| 4,659,248 | 4/1987 | Flanagan | 404/10 |

*Primary Examiner*—Stephen J. Novosad

*Assistant Examiner*—Gay Ann Spahn

[57] ABSTRACT

A deflecting rod reflector is designed for snow removal equipment areas. A cubically formed substantially pentagonally shaped rotatable deflecting reflector is housed in a hollow housing having an opened top and a semi-circular bottom. The housing is recessed flush into a road surface. The reflector can be deflected in two directions by car tires or snow plough blades, and while in the process of deflecting, will eject debris from the interior of the housing. Biasing springs attaching axle pins on the reflector support member to gudgeons in the side walls of the housing return the reflector support member back to a vertical position after the car or snow plow has moved on. The invention can be quickly and easily installed as a one piece unit in road recessions manufactured by equipment already used by California and other road maintenance services.

2 Claims, 3 Drawing Sheets

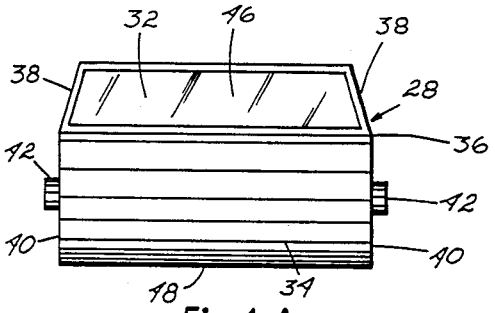
Fig. 1. A
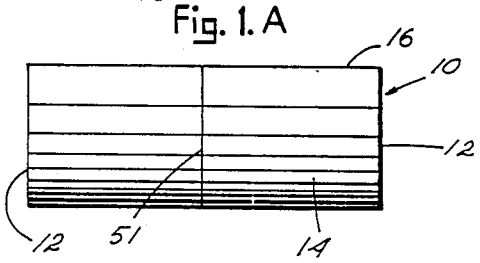
Fig. 1. B
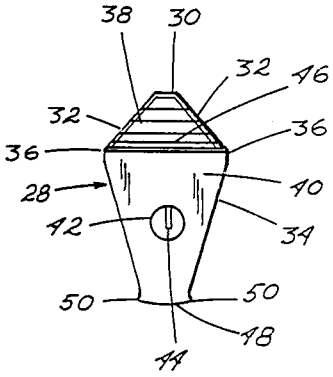
Fig. 2. A
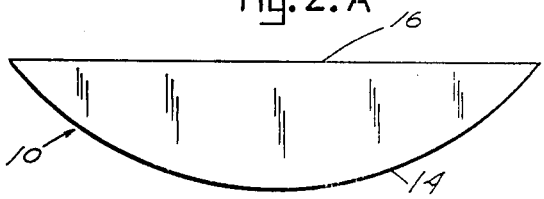
Fig. 2. B
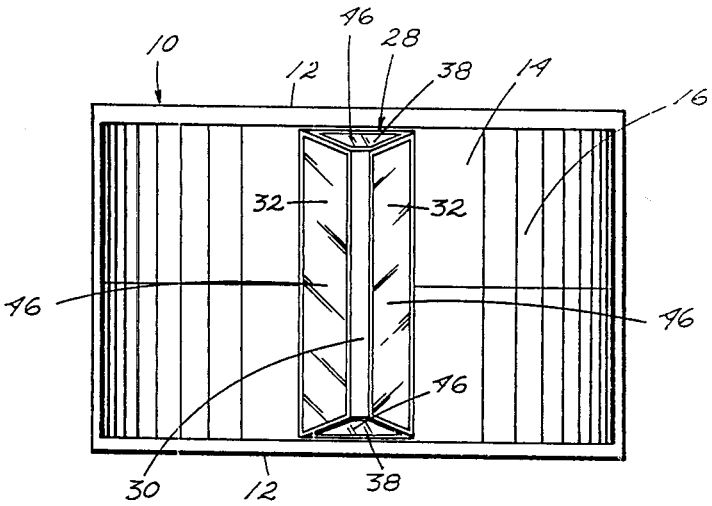
Fig. 3.

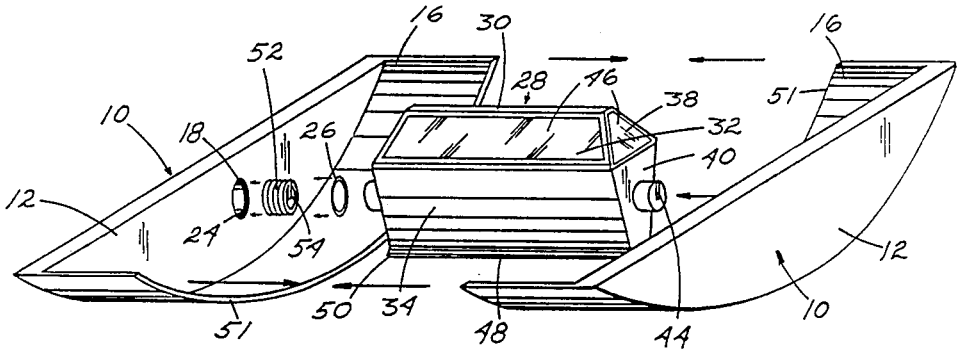
Fig. 4.
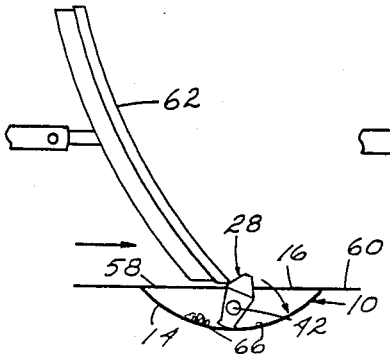
Fig. 5. A
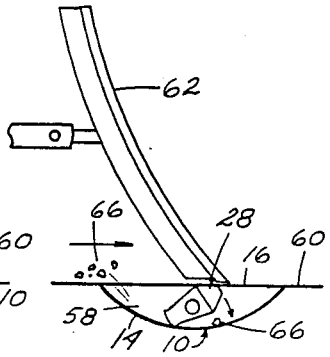
Fig. 5. B
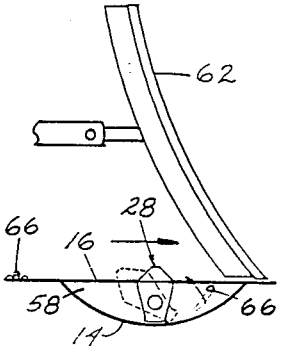
Fig. 5. C
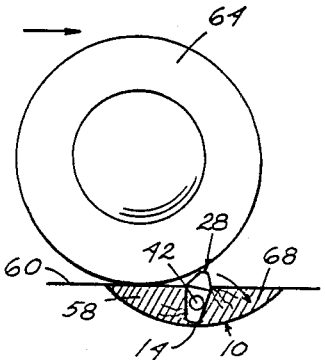
Fig. 6. A
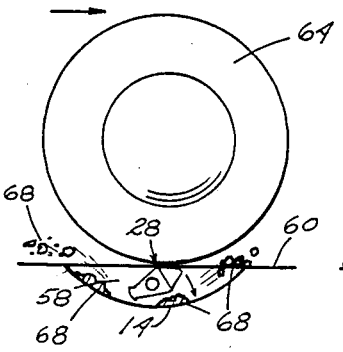
Fig. 6. B
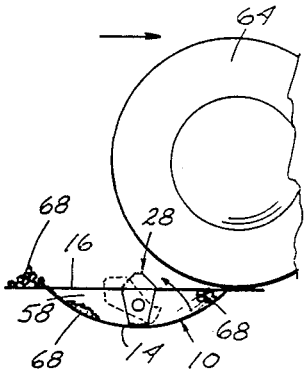
Fig. 6. C

RECESSED DEFLECTING ROAD REFLECTOR

BACKGROUND OF THE INVENTION

1. Field of the Invention:

This invention relates in general to reflective road surface devices used for reflecting light emitted from vehicle head lights. The present invention is particularly directed towards a deflecting and repositioning reflective road surface device designed for areas where snow removal equipment is used and stationary above surface road reflectors are in danger of inadvertent removal by the blades of snow ploughs.

2. Description of the Prior Art:

Reflective road markers have been in use for some time for the purpose of reflecting light from oncoming night time traffic to illuminate the lanes of the road for the drivers. The existing stationary reflectors are approximately three-fourths of an inch in height and are ineffective in areas of the country where snowfall necessitates the use of snow removal equipment. Unfortunately most of the stationary road reflectors are inadvertently removed by the blade of the snow plough. Excessive wear and tear by heavy vehicles also tends to deteriorate above surface stationary road reflectors, making frequent replacement a requirement. The necessity for deflecting or retracting road reflectors then developed, and several different types have since been produced.

A search was conducted which concentrated on the deflecting type of road reflectors. Devices which seemed most pertinent to my invention Were examined in the following classes and subclasses: 350/97, 590, 107, 404/10, and 11.

Many of the patents found disclosed road reflectors which have square or round housings and special equipment is required to install them. These devices included U.S. Pat. Nos. 1,845,774, 2,105,857, 2,176,285, 2,941,447, 2,981,149, 3,216,335, 4,130,370, 4,234,264 and 4,188,150.

U.S. Pat. Nos. 1,845,774, 2,176,285, and 4,140,418 illustrate unidirectional traffic signs and reflectors designed for use with one way traffic. Should a snow plough back over the device or remove snow in a direction opposite the normal flow of traffic damage would probably occur.

Several of the devices found, including U.S. Pat. Nos. 2,941,447, 4,148,418 and 4,362,425, illustrate reflectors which would prove to be somewhat ineffective in areas of the country experiencing moderate snowfall or in areas where mud proves to be a problem. Each of these devices have some sort of recessed reflecting surface or a side plate designed to guide the blade of a snow plough or tire over the reflector. This in itself creates a recessed or depressed area which could become filled or covered with snow or mud making the reflective surface ineffective.

Many of the past art patents strive to provide devices which are water tight and prevent water and debris from entering the inside of the housing. This is extremely difficult to accomplish effectively and if water or debris should accidentally be retained within the housing the device has no provision for removal. Several of the aforementioned devices, specifically U.S. Pat. Nos. 2,105,857, 2,981,149, 4,130,370, and 4,188,150, have deflecting portions of the devices which create a slight access or opening into the housing area when the reflector is actually in the deflected or depressed state.

Water and debris could conceivably enter during deflection and accumulate over time, eventually causing damage to the device. Maintenance of these devices is more time consuming and expensive when they contain protective caps attached with bolts or screws.

Some of the devices use a multiple of interconnecting parts as shown in U.S. Pat. Nos. 2,105,857, and 2,941,447. Others have housings which require special protective covers like those of U.S. Pat. Nos. 1,845,774, 2,176,285, 4,130,370, 2,105,857, and 2,941,447. Manufacture of the multiple piece devices and installation of the units having protective covers parts that need separate assembly at the site are not only time consuming but expensive. This is particularly true if specially manufactured installation equipment is necessary or if each device must be manually installed.

My invention overcomes the disadvantages seen in past art disclosures by providing a tilting reflector structure which produces a sweeping action to eject debris from a curved recessed reflector base. Additional useful improvements not seen in past art patents is described further in the following specification.

SUMMARY OF THE INVENTION

My invention is structured in the form of a cubically structured pentagonally shaped reflector support member having a bevel-sided reflector mounted in angled surfaces in an upwardly positioned section. The reflector support member is rotationally retained by two cylindrical axle pins in gudgeons between two vertical walls in an opened top hollow housing. The hollow housing has an upwardly curved semicircular bottom and is designed to fit existing road reflector receptacles or to be installed flush in a paved road surface as recessed housing for the deflecting reflector support member. The two adjacent axle pins are endwardly connected to biasing torsion springs located on the interior of two gudgeons which are in the nature of two cylindrical axle retaining bores in the housing side walls. These torsion biasing springs return the reflector to a vertical position visibly protruding above the recessed housing after the reflector support member has been disposed or deflected in either direction. As the reflector support member is rotated, a widened base section adjacent the curved housing bottom acts as a sweep and ejects debris or snow from the housing. An O-ring on the axle pins against the gudgeon openings prevents water from entering and causing the biasing springs to rust.

Therefore, it is a primary object of my invention to provide a deflecting road reflector which is specifically designed to be assembled and installed with installation equipment already available and in use by highway maintenance crews.

Another object of my invention is to provide a versatile, two-directional deflecting road reflector which can be used with two way traffic.

A further object of my invention is to provide a deflecting road reflector with an exposed, angled reflecting surface which effectively prohibits the build up of snow, ice or mud.

A still further object of my invention is to provide a deflecting road reflector which automatically expels water, snow, ice and mud from within the housing unit at the time the reflector is deflected.

Other objects and advantages of my invention will become apparent with a reading of the specification and subsequent comparison with the numbered parts shown in the accompanying drawings.

BRIEF DESCRIPTION OF THE DRAWINGS

FIG. 1 at A shows a side view of the reflector and the reflector support member and at B a front view of the housing is shown. A front and a rear view of the housing are identical.

FIG. 2 at A shows an end view of the reflector and illustrates the pentagonal shape of the support member and at B a side view of the housing is shown.

FIG. 3 is a top plan view of the reflector, the reflector support member, and the housing assembled.

FIG. 4 is a perspective exploded view of the component parts of the invention.

FIG. 5 is an in-use illustration with A showing the reflector partly deflected by the blade of a snow plough, B showing full deflection with debris ejected from the end of the housing, and C showing by dotted outline, the reflector in reverse deflection ejecting debris from the housing and by solid lines, the reflector returned to the original vertical position.

FIG. 6 is an in-use illustration with A showing beginning deflection by a tire where the housing contains ice, B showing full deflection, crushing the ice, and ejecting it out of the housing; and C illustrates post-deflection. The dotted outline represents the reflector in reverse deflection.

DRAWING REFERENCE NUMBERS

Figure 7:
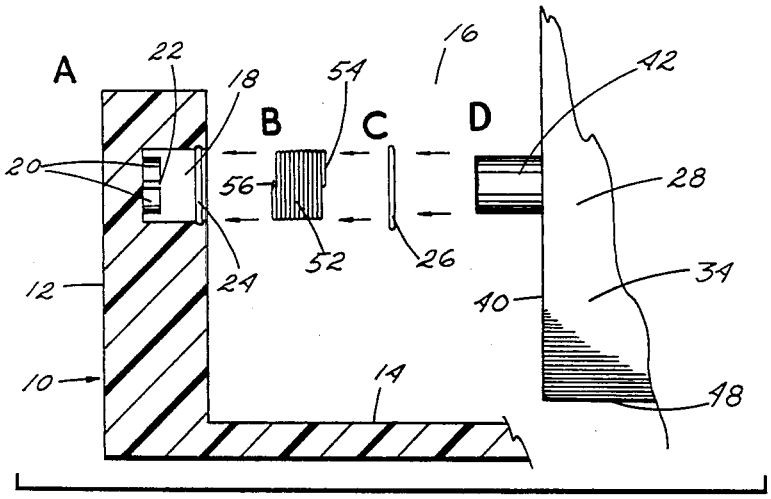
FIG. 7 is a cross sectional view of the housing with A showing the axle retaining bore of the gudgeon and the component parts of the deflecting means, B showing the torsion biasing spring, C showing the O-ring washer, and D showing the axle pin of the reflector.

10 housing
12 vertical side walls
14 curved bottom
16 opened top
18 gudgeons
20 attachment plate
22 horizontal retaining channel
24 gasket seat
26 O-ring gasket
28 reflector
30 top ridge
32 top reflector side
34 reflector support member
36 apex ridge
38 top reflector end
40 vertical end wall
42 axle pins
44 vertical retaining channel
46 reflective surface
48 convex base
50 ejecting flange
51 attachment edges
52 torsion biasing spring
54 vertical spring retainer
56 horizontal spring retainer
58 road recession
60 road surface
62 snow plough blade
64 tire
66 debris
68 ice

DESCRIPTION OF THE PREFERRED EMBODIMENT

Figure 8:
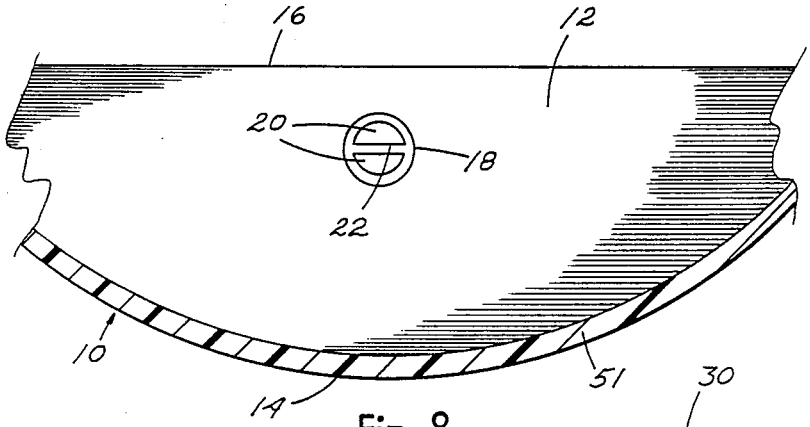
FIG. 8 is an interior view of one side of the housing showing the axle retaining bore of the gudgeon.

Referring now to the drawings and to FIG. 1 where the preferred embodiment of the invention is shown in an unassembled view. Housing 10, shown in a front or rear view in FIG. 1 B and in a side view in FIG. 2 B, is comprised of a hollow container having two parallel vertical side walls 12, a curved bottom 14, and an opened top section 16. The vertical side walls 12 are both centrally affixed by inwardly faced horizontally aligned cylindrical axle bores designated gudgeon 18, as shown in FIG. 4 and FIG. 8. The closed end of gudgeon 18 is affixed with cylindrical attachment plate 20, sized slightly smaller in diameter than the interior of gudgeon 18, seen in FIG. 7 and 8. The distal end of attachment plate 20 is entrenched with horizontal retaining channel 22. Adjacent the open end of gudgeon 18 is a circumferential groove designated gasket seat 24, shown in FIG. 7. O-ring gasket 26, seen in FIG. 4 and 7, fits into gasket seat 24 to provide a water proof seal.

The movable reflective portion of the invention is comprised of reflector 28, seen in FIG. 1 A, FIG. 2 A and in FIG. 4, 5 and 6. Reflector 28 is an upwardly section of reflector support member 34 formed into an elongated triangular structure having a narrow top ridge 30 with beveled ends which form top reflector end 38, best seen in profile in FIG. 2 A. Where top reflector side 32 fastens to reflector support member 34 they form a lengthwise ridge designated apex ridge 36, located approximately one third down the height of each reflector 28. Apex ridge 36 is continued around top reflector ends 38 where top reflector end 38 bevels upwardly and inwardly to connect to top ridge 30. The bottom section of each end of reflector support member 34 is designated vertical end wall 40 to which is centrally attached one cylindrical axle pin 42. Axle pin 42 is sized to be movably retained in gudgeon 18 of housing 10. The distal end of axle pin 42 is affixed with vertical retaining channel 44. Both sides of top reflector side 32 and both beveled ends, top reflector end 38, are affixed with reflective surface 46, shown in FIG. 1A, FIG. 3 and FIG. 4. Reflective surface 46 is a reflective finishing or a reflective material which is visible to motorists in the dark by reflecting headlight beams and somewhat by a retained charge in the materials used. The extreme bottom surface of reflector support member 34 is formed into convex base 48 which conforms to the angle of curved bottom 14 of housing 10. Convex base 48 forms edgewardly, ejecting flange 50, shown in FIG. 2 A, and FIG. 4.

Figure 9:
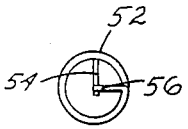
FIG. 9 is an end view of the torsion biasing spring and the horizontal biasing spring retainer, which is inserted into the axle retaining bore of the gudgeon.
Figure 10:
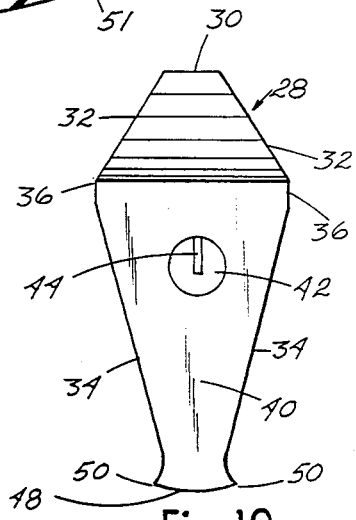
FIG. 10 is an enlarged end view of the reflector structure showing the pentagonal shape of the reflector support member.

During assembly, the two parallel sections of housing 10 are positioned with attachment edges 51 adjacent one another, as seen in FIG. 4, having one side positioned to either side of axle pin 42 of reflector support member 34, aligning each gudgeon 18 with each axle pin 42. Torsion biasing spring 52, shown in FIG. 4 and 9, is coiled with each distal end bent inwardly to form on one end, vertical spring retainer 54, and oppositely, horizontal spring retainer 56, as seen in FIG. 9. One torsion biasing spring 52 is inserted into each gudgeon 18 of housing 10 and positioned over attachment plate 20 with horizontal spring retainer 56 being inserted in horizontal retaining channel 22. O-ring gasket 26 is then installed in gasket seat 24 of each gudgeon 18 and the two parallel sections of housing 10 are brought together with each gudgeon 18 being fitted over each axle pin 42 with vertical spring retainer 54 being inserted into vertical retaining channel 44 on the distal end of axle pin 42. Attachment edges 51, shown in FIG. 4, of housing 18 are fused together by adhesive or sonic bonding methods. The assembled invention is now inserted as an assembled unit into road recession 58, by adhesive or other means, which is positioned lengthwise, parallel to the road edge and flush with road surface 60. The invention is designed to fit into existing road reflector housing, fit existing road reflector housing cavities, or to be installed as complete units depressed flush in road surfaces. Installation can be accomplished easily with available equipment and quickly since no accessory protective cap needs to be attached.

In use, reflector 28, the top of reflector support member 34, is deflected forward by snow plough blade 62, as seen in FIG. 5, or by tire 64, shown in FIG. 6. Upon full deflection, top reflector side 32 is positioned in a horizontal plane level with road surface 60. The forward deflecting action of the top section, reflector 28, of reflector support member 34, causes the bottom section to rotate backwards while ejecting flange 50 located on convex base 48 ejects or knocks debris 66 out of the interior back portion of curved bottom 14 of housing 10. After snow plough blade 62 or tire 64 has passed over reflector 28, the tension provided by torsion biasing spring 52 causes reflector support member 34 to rotate backwards. This reverse deflection causes ejecting flange 50 on the front side of reflector support member 34 to sweep debris 66, consisting of sand, small rocks, mud, and snow, out from the interior front portion of curved bottom 14 of housing 10. Sufficient space exists between deflected reflector support member 34 and the interior of housing 10 for retaining limited portions of debris 66 during passage of snow plough blade 62 or tire 64 to prevent damage to reflector 28 or reflector support member 34 before reverse deflection ejects debris 66. When debris 66 consists of ice 68, as seen in FIG. 6, the forward deflection of reflector support member 34 crushes ice 68, forcing most of it out the front section of the interior of housing 10. The reverse deflecting action ejects the rest of ice 68. Since road recession 58 and housing 10 are narrow in size, and reflector support member 34 and housing 10 are manufactured of very strong and durable material, ice 68 is easily crushed without damage to the device.

Although I have described my invention with considerable details in the specification, it is to be understood that in practicing my invention, I may alter the design or structure so long as any alterations remain within the intended scope of the appended claims.

What I claim as my invention is:

1. A deflecting road reflector with housing for depressed insertion into existing road reflector receptacles and for new installations as complete fixtures set flush in a paved road surface comprising, a hollow housing with a substantially rectangularly formed opened side upwardly positioned as a top thereof, two vertical side walls having upper edges aligned horizontally and lower edges curved upwardly from a deepened center position to null at both ends, there being a curved bottom attached in paralleling curved alignment to said lower curved edges of said side walls, the end edges of said curved bottom and said upper edges aligned horizontally of said vertical side walls structuring said substantially rectangularly formed opened top of said hollow housing;

a reflector support member cubically formed, substantially pentagonally shaped, and sized for rotational attachment about an axis transverse to the longitudinal axis of said hollow housing such that rotation occurs in said housing centrally between said two vertical side walls, said reflector support member being attached by pins passed through coiled biasing springs inserted in gudgeons in said vertical walls, said pins affixed to both ends of said reflector support member at an upward location and said biasing springs retaining said reflector support member said reflector support member standing vertically where at rest with an upper section protruding above said upwardly opened top of said hollow housing;

a light reflecting structure being said upward protruding section of said reflector support member triangularly peaked with beveled ends, there being light reflective applications on both triangularly formed surfaces and both beveled end surfaces;

a debris ejection sweep being a lower portion of said reflector support member affixed at a bottom edge of said reflector support member with a convex surfaced end and widened at the bottom edge immediate to said curved housing bottom into a debris ejection sweep; said biasing springs in said gudgeons allowing said reflector support member to be rotatably deflected in a clockwise direction from opposite directions with said biasing springs returning said reflector support member immediately to a vertical position on release of a displacing force.

2. The deflecting road reflector of claim 1 wherein said light reflecting applications on both said angle formed surfaces and both said beveled ends of said light reflecting structure includes shiny finished surfaces, light reflective materials attached, a reflective coating applied, and similar affixing in a manner to reflect lights beamed thereon.

* * * * *